US006259337B1

(12) United States Patent
Wen

(10) Patent No.: US 6,259,337 B1
(45) Date of Patent: Jul. 10, 2001

(54) HIGH EFFICIENCY FLIP-CHIP MONOLITHIC MICROWAVE INTEGRATED CIRCUIT POWER AMPLIFIER

(75) Inventor: Cheng P. Wen, Mission Viejo, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/377,274

(22) Filed: Aug. 19, 1999

(51) Int. Cl.[7] ..... H01P 5/12; H01P 3/08
(52) U.S. Cl. ..... 333/246; 333/128; 333/33
(58) Field of Search ..... 333/246, 247, 333/128, 33; 330/286

(56) References Cited

U.S. PATENT DOCUMENTS 5,528,203 * 6/1996 Mohwinkel et al. ..... 333/128

* cited by examiner

*Primary Examiner*—Benny Lee
*Assistant Examiner*—Kimberly E Glenn
(74) *Attorney, Agent, or Firm*—Leonard A. Alkov; Glenn H. Lenzen, Jr.

(57) ABSTRACT

A coplanar waveguide structure for use in constructing a monolithic microwave integrated circuit high power amplifier. The coplanar waveguide structure is a coplanar transmission line segment having more than two ground plane electrodes and a plurality of signal/dc current carrying electrodes. The current carrying electrodes are each separated from an adjacent ground plane electrode by a gap. The coplanar waveguide structure forms a shunt inductor for the monolithic microwave integrated circuit high power amplifier. The electrodes are shorted at one end to form the shunt inductor. A center ground plane electrode is preferably at least twice the width of the signal carrying electrode. The gaps between the signal carrying electrode and the ground electrodes are preferably at least one half the width of the signal carrying electrode to minimize current crowding.

9 Claims, 1 Drawing Sheet

Equivalent circuit

HIGH EFFICIENCY FLIP-CHIP MONOLITHIC MICROWAVE INTEGRATED CIRCUIT POWER AMPLIFIER

BACKGROUND

The present invention relates generally to high power amplifiers, and more particularly, to an improved coplanar waveguide structure that forms an improved inductor for use with monolithic microwave integrated circuit high power amplifiers.

Prior art relating to monolithic microwave integrated circuit (MMIC) high power amplifier output matching circuit designs includes the following. Certain prior art MMIC high power amplifiers use microstrip based circuitry. Circuit loss diminishes with wider microstrip line width. The loss of the output matching circuit is of the order of 0.5 dB for conventional X-band power MMIC amplifiers. Microstrip based circuitry is not compatible with flip-chip module assembly techniques.

Other prior art MMIC high power amplifiers use a coplanar waveguide with a very wide signal carrying strip to meet dc current carrying requirements. Current crowding of coplanar waveguide with large strip-to-gap ratio leads to a low Q factor, and higher circuit loss. Flip-chip amplifier efficiency suffers when such lower Q, critical resonant circuit elements are employed.

It would therefore be desirable to have a coplanar waveguide structure for use with monolithic microwave integrated circuit high power amplifiers that improves upon conventional designs.

SUMMARY OF THE INVENTION

The present invention provides for a coplanar waveguide structure for use with a monolithic microwave integrated circuit high power amplifier. The coplanar waveguide structure comprises a coplanar transmission line segment having more than two ground plane electrodes and a plurality of signal/dc current carrying electrodes. The current carrying electrodes are each separated from an adjacent ground plane electrode by a gap. The coplanar waveguide structure forms an improved inductor for the monolithic microwave integrated circuit high power amplifier. A center ground plane electrode is preferably at least twice the width of the signal carrying electrode. The gaps between the signal carrying electrode and the ground electrodes are preferably at least one half the width of the signal carrying electrode to minimize current crowding.

The present invention uses a high Q planar inductor that is compatible with flip-chip MMIC technology. The effective width of the signal carrying metal strip is able to handle the dc current required for operation of the high power amplifier without risking current metal migration.

The present invention makes use of closely spaced, parallel coplanar waveguide (CPW) segments shorted at one end to form a shunt inductor at the output of high power flip-chip, monolithic microwave integrated circuit (MMIC) amplifiers. As a part of the output matching circuitry, the shunt inductors are at resonance with the drain-source capacitance of output-transistors at the RF signal frequency. Because there is less current crowding at the edge of the conductors, the coplanar inductor configuration offers higher circuit Q-factor compared with conventional CPW inductors with an identical strip width and characteristic impedance. The reduction in output matching circuit loss is critical to high efficiency operation of very high power flip-chip MMIC amplifiers, such as those used in active array radar.

The present invention improves the power added efficiency (PAE) of flip-chip, high power MMIC amplifiers for active array antenna applications. The present invention provides higher monolithic microwave integrated circuit amplifier efficiency through lower circuit loss at the output impedance transformer section. The use of a higher Q-factor coplanar inductor at the drain electrode of the output transistors serves to reduce signal loss per cycle. The reduction in RF power loss at the output of a high power amplifier directly impacts the power added efficiency of circuit operation. Higher RF amplifier efficiency leads to lower prime power demand, power supply size reduction, improved thermal management and lower system manufacturing cost.

The present invention may be used in all field effect transistor (FET) amplifiers, including MESFET and high electron mobility transistors (HEMT) based high power monolithic microwave integrated circuit (MMIC) amplifiers. The present invention will have beneficial impact on MMIC based, active array radar systems, and communication systems, developed by the assignee of the present invention.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

High power, flip-chip MMIC technology promises significant cost savings for active array radar transceiver module manufacturing. This emerging technology has not yet reached full potential because of certain circuit performance concerns. Recently, a very high power (over 7 W), two-stage, flip-chip MMIC amplifier operating over nearly the entire X-band frequency range has been developed by the assignee of the present invention.

However, despite the high output power and broad bandwidth characteristics, flip-chip MMIC amplifiers seem to exhibit slightly lower power added efficiency (PAE), compared with their counterparts using a face up design. The present invention provides means to improve flip-chip MMIC power amplifier efficiency through RF signal loss reduction at the output matching circuitry.

Circuit loss at the output impedance transformer section of an RF amplifier dictates the maximum achievable power added efficiency. It is therefore critically important to reduce the matching circuit loss at the output of a MMIC amplifier to a minimum.

Figure 1:
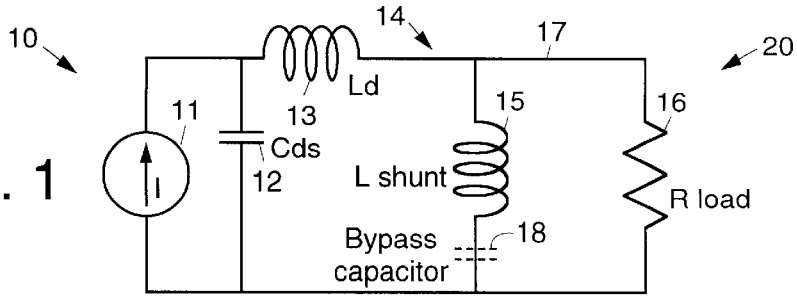
FIG. 1 illustrates an equivalent circuit of a transistor amplifier output matching transformer with lossless reactive circuit elements.
Figure 2:
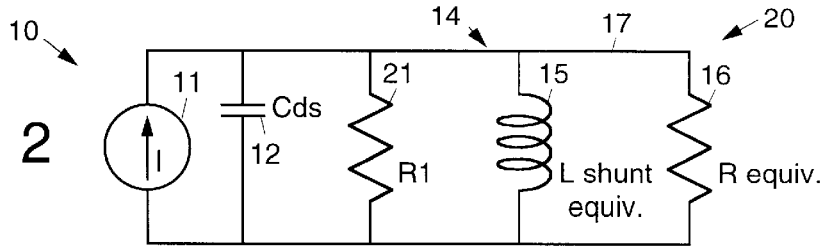
FIG. 2 illustrates an equivalent circuit of a transistor amplifier output matching transformer with realistic lossy circuit elements.

Referring to the drawing figures, FIGS. 1 and 2 show equivalent circuits of a portion of a high power amplifier 10 comprising a typical field effect transistor (FET) or pseudomorphic high electron mobility transistor (pHEMT) based MMIC HPA output matching section 20. FIG. 1 shows the equivalent circuit of the output matching transformer section 20 of the amplifier 10 having lossless reactive circuit elements. FIG. 2 shows the equivalent circuit of the output matching transformer section of the amplifier 10 having realistic lossy circuit elements.

The transistor 11 is represented by a constant current source 11, a shunt capacitor (Cds) 12 and a drain inductance (Ld) 13. A first section of an RF impedance transformation network 14 adjacent the output transistor 11 typically includes a shunt inductor 15 at resonance with the effective source drain capacitance 12 of the transistor 11. A resistive load (R) 16 is approximately equal to the dc load line of the output transistor 11.

Ohmic loss of transmission line segments 17 forming a part of the output transformer section 14 and the Q-factor of the shunt inductor 15 both contribute to amplifier power added efficiency degradation. The characteristic impedance of the transmission line segments 17 connecting the drain of the output transistor 11 to the RF load 16 is typically in the 40 ohm to 70 ohm range.

Figure 1A:
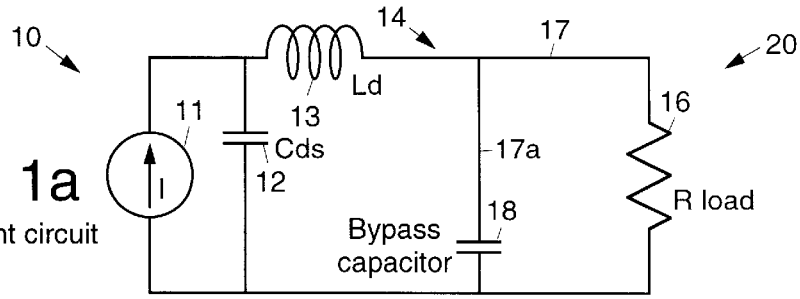
FIG. 1*a* illustrates an alternative representation of the transistor amplifier output matching transformer of FIG. 1.

FIG. 1*a* illustrates an alternative representation of the transistor amplifier output matching transformer section 20 of FIG. 1 wherein the shunt inductor 15 is provided by a transmission line segment 17*a* and a bypass capacitor 18. A short (less than a quarter of a wavelength long at the RF signal frequency) transmission line segment 17*a* is terminated by a large by-pass capacitor 18 (RF short) at one end to form the shunt inductor 15. It is typically formed using a wide metal strip to accommodate the dc bias current required to operate the output transistor 11 of the power amplifier 10. The dc current density at the inductor 15 must remain below 4E5 A/cm^2 to prevent premature circuit failure caused by current induced metal migration.

In the case of conventional face-up MMIC amplifiers 10 with microstrip based circuitry, wider strip width leads to reduced current density and lower transmission line loss. Also, lower Q-factor (higher circuit loss) is exhibited by coplanar waveguide based flip-chip circuitry using a wide center strip especially if gaps between the center strip and ground planes are not expanded.

Current crowding at the edge of electrodes forming coplanar waveguide is the real culprit. The energy stored in the LC resonant circuit (comprising the shunt capacitor (Cds) 12 and drain inductance (Ld) 13 plus the external shunt inductor 15 spends half the time in the capacitor 12 and half the time in the inductors 13, 15. Increased shunt inductor loss, which can be expressed as a shunt resistor 21 (R1) shown in FIG. 2 will divert some of the current from the transistor 11 (constant current source 11) from the RF load 16. A part of the RF current from the transistor 11 is consumed in the shunt resistor 21 (R1), resulting in amplifier power added efficient degradation.

Figure 3:
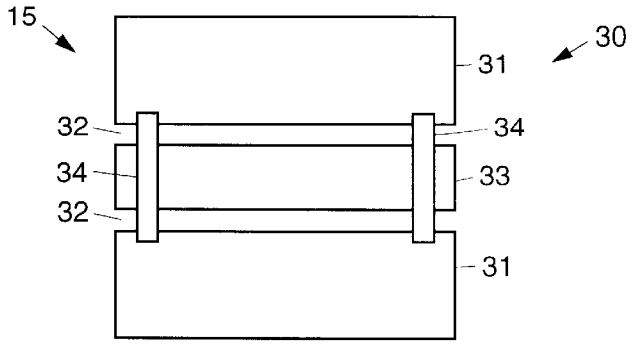
Fig. 3 (PRIOR ART)
FIG. 3 illustrates a conventional coplanar waveguide for use in a MMIC high power amplifier.

FIG. 3 illustrates a conventional coplanar waveguide structure 30 over which the present invention provides an improvement. The conventional coplanar waveguide structure 30 forms an inductor 15 used in the output matching transformer section 20 of a conventional high power amplifier 10. The conventional coplanar waveguide structure 30 comprises two outer ground plane electrodes 31 separated by gaps 32 from a single signal electrode 33. Ground straps 34 are provided to bridge the two ground plane electrodes 31.

Figure 4:
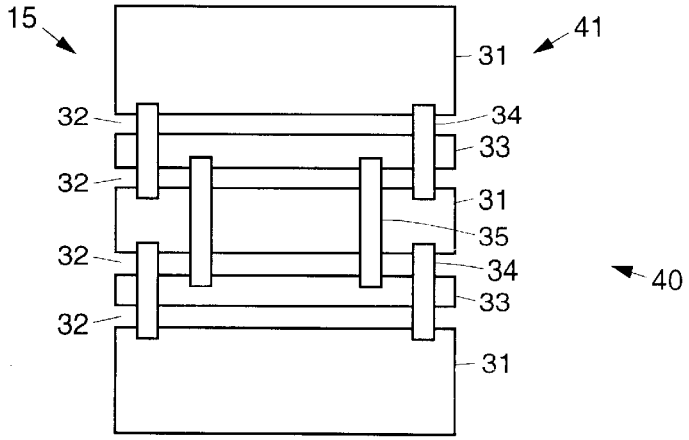
FIG. 4 illustrates an exemplary high Q-factor coplanar waveguide in accordance with the principles of the present invention for use in an improved MMIC high power amplifier.

FIG. 4 illustrates an exemplary high Q-factor coplanar waveguide structure 40 in accordance with the principles of the present invention that forms an improved inductor 15 used in the output matching transformer section 20 of a high power amplifier 10. The coplanar waveguide structure 40 comprises a coplanar transmission line segment 41 having more than two ground plane electrodes 3 1, and comprises more than one signal (and dc current) carrying electrode 33. One or more signal straps 35 couple RF/dc signals between the respective signal carrying electrodes 33.

FIG. 4 shows an example of such an inductor 15 with two signal carrying electrodes 33. RF current is more evenly distributed because the transmission line segment 41 is actually two lines in parallel. The shunt inductor 15 in this novel configuration provides for an inductor 15 with higher Q, and lower loss. The end result is improved amplifier power added efficiency for a flip-chip MMIC high power amplifier employing the high Q-factor coplanar waveguide 40.

It is desirable to have the sum of the widths of the two signal carrying electrodes 33 of the high Q-factor coplanar waveguide 40 shown in FIG. 4 be equal to the width of the single signal carrying electrode 33 of the shunt inductor 15 of the conventional coplanar waveguide 30 shown in FIG. 3. A center ground plane electrode 31 is preferably at least twice the width of each of the two signal carrying electrodes 33. Current crowding is minimized if the gaps 32 between the signal carrying electrodes 33 and the ground electrodes 31 are at least one half the width of the signal carrying electrodes 33.

Thus, a coplanar waveguide structure for use with monolithic microwave integrated circuit high power amplifiers has been disclosed. It is to be understood that the above-described embodiment is merely illustrative of one of the many specific embodiments that represent applications of the principles of the present invention. Clearly, numerous and other arrangements can be readily devised by those skilled in the art without departing from the scope of the invention.

What is claimed is:

1. A coplanar waveguide structure for use with a high power amplifier, comprising:

a coplanar transmission line segment having more than two ground plane electrodes and a plurality of signal/dc current carrying electrodes, which current carrying electrodes are each separated from an adjacent ground plane electrode by a gap, which coplanar waveguide structure forms a shunt inductor for the high power amplifier, wherein a center ground plane electrode is at least twice the width of the signal carrying electrode.

2. The coplanar waveguide structure recited in claim 1 wherein the coplanar waveguide segments are shorted at one end to form the shunt inductor.

3. The coplanar waveguide structure recited in claim 1 wherein the high power amplifier comprises a flip-chip, monolithic microwave integrated circuit amplifier.

4. A coplanar waveguide structure for use with a monolithic microwave integrated circuit high power amplifier, comprising:

a coplanar transmission line segment having more than two ground plane electrodes and a plurality of signal/dc current carrying electrodes, which current carrying electrodes are each separated from an adjacent ground plane electrode by a gap, which electrodes are shorted at one end to form a shunt inductor for the monolithic microwave integrated circuit high power amplifier, wherein a center ground plane electrode is at least twice the width of the signal carrying electrode.

5. A coplanar waveguide structure for use with a monolithic microwave integrated circuit high power amplifier, comprising:

a coplanar transmission line segment having more than two ground plane electrodes and a plurality of signal/dc current carrying electrodes, which current carrying electrodes are each separated from an adjacent ground plane electrode by a gap, which gaps are at least one half the width of the signal carrying electrodes, and wherein a center ground plane electrode is at least twice the width of the signal carrying electrodes, which coplanar waveguide structure forms a shunt inductor for the monolithic microwave integrated circuit high power amplifier.

6. A coplanar wavguide structure for use with a high power amplifier, comprising:

a coplanar transmission line segment having more than two ground plane electrodes and a plurality of signal/dc current carrying electrodes, which current carrying electrodes are each separated form an adjacent ground plane electrode by a gap, which coplanar waveguide structure forms a shunt inductor for the high power amplifier, wherein the gaps between the signal carrying electrode and the ground electrodes are at least one half of the width of the signal carrying electrode to minimize current crowding.

7. The coplanar waveguide structure recited in claim 6 wherein the coplanar waveguide segments are shorted at one end to form the shunt inductor.

8. The coplanar waveguide structure recited in claim 6 wherein the high power amplifier comprises a flip-chip, monolithic microwave integrated circuit amplifier.

9. A coplanar waveguide structure for use with a monolithic microwave integrated circuit high power amplifier, comprising:

a coplanar transmission line segment having more than two ground plane electrodes and a plurality of signal/dc current carrying electrodes, which current carrying electrodes are each separated from an adjacent ground plane electrode by a gap, which electrodes are shorted at one end to form a shunt inductor for the monolithic microwave integrated circuit high power amplifier, wherein the gaps between the signal carrying electrode and ground electrodes are at least one half the width of the signal carrying electrode to minimize current crowding.

* * * * *